US009875748B2

(12) United States Patent
Srinivasan

(10) Patent No.: US 9,875,748 B2
(45) Date of Patent: Jan. 23, 2018

(54) AUDIO SIGNAL NOISE ATTENUATION

(71) Applicant: KONINKLIJKE PHILIPS N.V., Eindhoven (NL)

(72) Inventor: Sriram Srinivasan, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 71 days.

(21) Appl. No.: 14/351,646

(22) PCT Filed: Oct. 22, 2012

(86) PCT No.: PCT/IB2012/055792
§ 371 (c)(1),
(2) Date: Apr. 14, 2014

(87) PCT Pub. No.: WO2013/061232
PCT Pub. Date: May 2, 2013

(65) Prior Publication Data

US 2014/0249809 A1 Sep. 4, 2014

Related U.S. Application Data

(60) Provisional application No. 61/550,512, filed on Oct. 24, 2011.

(51) Int. Cl.
*G10L 21/02* (2013.01)
*G10L 19/012* (2013.01)
(Continued)

(52) U.S. Cl.
CPC ..... *G10L 19/012* (2013.01); *G10L 21/0202* (2013.01); *G10L 21/0208* (2013.01);
(Continued)

(58) Field of Classification Search
CPC ..... G10L 21/00; G10L 21/02; G10L 21/0202; G10L 21/0208; G10L 21/02082;
(Continued)

(56) References Cited

U.S. PATENT DOCUMENTS 6,230,124 B1 * 5/2001 Maeda ..... G10L 19/005 704/222
6,970,558 B1 * 11/2005 Schmidt ..... H04M 9/082 379/406.01
(Continued)

FOREIGN PATENT DOCUMENTS

EP 1450354 A1 8/2004
EP 2363853 A1 9/2011
(Continued)

OTHER PUBLICATIONS

M. Stuttle, "A Gaussian Mixture Model Spectral Representation for Speech Recognition", at p. 45, Jul. 2003. http://mi.eng.cam.ac.uk/~mjfg/thesis_mns25.pdf.*
(Continued)

*Primary Examiner* — Richard Zhu
(74) *Attorney, Agent, or Firm* — Larry Liberchuck

(57) ABSTRACT

A noise attenuation apparatus receives an audio signal comprising a desired and a noise signal component. Two codebooks (109, 111) comprise respectively desired signal candidates representing a possible desired signal component and noise signal contribution candidates representing possible noise contributions. A segmenter (103) segments the audio signal into time segments and for each time segment a noise attenuator (105) generates estimated signal candidates by for each of the desired signal candidates generating an estimated signal candidate as a combination of a scaled version of the desired signal candidate and a weighted combination of the noise signal contribution candidates. The noise attenuator (105) minimizes a cost function indicative of a difference between the estimated signal candidate and the audio signal in the time segment. A signal candidate is then determined for the time segment from the estimated
(Continued)

signal candidates and the audio signal is noise compensated based on this signal candidate.

15 Claims, 3 Drawing Sheets

(51) Int. Cl.
*G10L 21/0208* (2013.01)
*G10L 21/0216* (2013.01)

(52) U.S. Cl.
CPC ..... *G10L 21/02* (2013.01); *G10L 21/0216* (2013.01); *G10L 2021/02163* (2013.01); *G10L 2021/02165* (2013.01); *G10L 2021/02166* (2013.01)

(58) Field of Classification Search
CPC ..... G10L 21/02085; G10L 21/02087; G10L 21/0216; G10L 2021/02163; G10L 2021/02165; G10L 2021/02166; G10L 2021/02161; G10L 15/20; G10L 19/005; G10L 19/012; G10L 19/035
See application file for complete search history.

(56) References Cited

U.S. PATENT DOCUMENTS 7,797,156 B2 * 9/2010 Preuss ..... G10L 15/20 704/226
2004/0076287 A1 * 4/2004 Baeder ..... G10L 19/012 379/399.01
2004/0102967 A1 * 5/2004 Furuta ..... G10L 21/0208 704/226
2004/0167777 A1 * 8/2004 Hetherington ..... G10L 21/0208 704/226
2004/0267521 A1 * 12/2004 Cutler ..... G10L 15/25 704/202
2005/0055203 A1 3/2005 Makinen
2007/0055508 A1 * 3/2007 Zhao ..... G10L 21/0216 704/226
2008/0140396 A1 * 6/2008 Grosse-Schulte ..... G10L 15/20 704/227
2009/0076813 A1 * 3/2009 Jung ..... G10L 15/20 704/233
2009/0185704 A1 * 7/2009 Hockley ..... G10L 17/26 381/316
2010/0266152 A1 10/2010 Rosenkranz
2011/0096942 A1 * 4/2011 Thyssen ..... G10L 21/0208 381/94.1
2011/0170711 A1 * 7/2011 Rettelbach ..... G10L 19/02 381/98
2012/0072207 A1 * 3/2012 Morii ..... G10L 19/008 704/201
2013/0297299 A1 * 11/2013 Chakrabartty ..... G10L 15/02 704/211
2014/0122504 A1 * 5/2014 Courtier-Dutton ..... G06F 17/30038 707/748
2014/0249810 A1 9/2014 Kechichian

FOREIGN PATENT DOCUMENTS

JP H04344699 A 12/1992
JP 2008116952 A 5/2008

OTHER PUBLICATIONS

Srinivasan S. et al., "Codebook Driven Short-Term Predictor Parameter Estimation for Speech Enhancement", IEEE Transactions on Audio, Speech and Language Processing, IEEE Service Center, New York, NY, USA, vol. 14, No. 1,Jan. 1, 2006 (Jan. 1, 2006), pp. 163-176, XP002551735.
Tobias Rosenkranz, "Modeling the Temporal Evolution of LPC Parameters for Codebook-Based Speech Enhancement", Image and Signal Processing and Analysis, 2009. ISPA 2009. Proceedings of 6th International Symposium on, IEEE, Piscataway, NJ, USA, Sep. 16, 2009 (Sep. 16, 2009), pp. 455-460, XP031552102.
Srinivasan S. et al., "Codebook Based Bayesian Speech Enhancement for Non-Stationary Environments," IEEE Trans. Speech Audio Processing, vol. 15, No. 2, pp. 441-452, Feb. 2007.
Srinivasan, S. et al., "Speech Enhancement Using a-Priori Information," in Proc. Eurospeech, Sep. 2003, pp. 1405-1408.
Martin, R. et al., "Noise Power Spectral Density Estimation Based on Optimal Smoothing and Minimum Statistics," IEEE Trans. Speech and Audio Processing, vol. 9, No. 5, pp. 504-512, Jul. 2001.

* cited by examiner

AUDIO SIGNAL NOISE ATTENUATION

FIELD OF THE INVENTION

The invention relates to audio signal noise attenuation and in particular, but not exclusively, to noise attenuation for speech signals.

BACKGROUND OF THE INVENTION

Attenuation of noise in audio signals is desirable in many applications to further enhance or emphasize a desired signal component. For example, enhancement of speech in the presence of background noise has attracted much interest due to its practical relevance. A particularly challenging application is single-microphone noise reduction in mobile telephony. The low cost of a single-microphone device makes it attractive in the emerging markets. On the other hand, the absence of multiple microphones precludes beam former-based solutions to suppress the high levels of noise that may be present. A single-microphone approach that works well under non-stationary conditions is thus commercially desirable.

Single-microphone noise attenuation algorithms are also relevant in multi-microphone applications where audio beam-forming is not practical or preferred, or in addition to such beam-forming. For example, such algorithms may be useful for hands-free audio and video conferencing systems in reverberant and diffuse non-stationary noise fields or where there are a number of interfering sources present. Spatial filtering techniques such as beam-forming can only achieve limited success in such scenarios and additional noise suppression needs to be performed on the output of the beam-former in a post-processing step.

Various noise attenuation algorithms have been proposed including systems which are based on knowledge or assumptions about the characteristics of the desired signal component. In particular, knowledge-based speech enhancement methods such as codebook-driven schemes have been shown to perform well under non-stationary noise conditions, even when operating on a single microphone signal. Examples of such methods are presented in: S. Srinivasan, J. Samuelsson, and W. B. Kleijn, "Codebook driven short-term predictor parameter estimation for speech enhancement", IEEE Trans. Speech, Audio and Language Processing, vol. 14, no. 1, pp. 163 {176, January 2006 and S. Srinivasan, J. Samuelsson, and W. B. Kleijn, "Codebook based Bayesian speech enhancement for non-stationary environments," IEEE Trans. Speech Audio Processing, vol. 15, no. 2, pp. 441-452, February 2007.

These methods rely on trained codebooks of speech and noise spectral shapes which parameterized by e.g., linear predictive (LP) coefficients. The use of a speech codebook is intuitive and lends itself readily to a practical implementation. The speech codebook can either be speaker independent (trained using data from several speakers) or speaker dependent. The latter case is useful for e.g. mobile phone applications as these tend to be personal and often predominantly used by a single speaker. The use of noise codebooks in a practical implementation however is challenging due to the variety of noise types that may be encountered in practice. As a result a very large noise codebook is typically used.

Typically, such codebook based algorithms seek to find the speech codebook entry and noise codebook entry that when combined most closely matches the captured signal. When the appropriate codebook entries have been found, the algorithms compensate the received signal based on the codebook entries. However, in order to identify the appropriate codebook entries a search is performed over all possible combinations of the speech codebook entries and the noise codebook entries. This results in computationally very resource demanding process that is often not practical for especially low complexity devices. Furthermore, the large noise codebooks are cumbersome to generate and store, and the large number of possible noise candidates may increase the risk of an erroneous estimate resulting in a suboptimal noise attenuation.

Hence, an improved noise attenuation approach would be advantageous and in particular an approach allowing increased flexibility, reduced computational requirements, facilitated implementation and/or operation, reduced cost and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided a noise attenuation apparatus comprising: a receiver for receiving an audio signal comprising a desired signal component and a noise signal component; a first codebook comprising a plurality of desired signal candidates for the desired signal component, each desired signal candidate representing a possible desired signal component; a second codebook comprising a plurality of noise signal contribution candidates, each noise signal contribution candidate representing a possible noise contribution for the noise signal component; a segmenter for segmenting the audio signal into time segments; a noise attenuator arranged to, for each time segment, perform the steps of: generating a plurality of estimated signal candidates by for each of the desired signal candidates of the first codebook generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment, generating a signal candidate for the audio signal in the time segment from the estimated signal candidates, and attenuating noise of the audio signal in the time segment in response to the signal candidate.

The invention may provide improved and/or facilitated noise attenuation. In many embodiments, a substantially reduced computational resource is required. The approach may allow more efficient noise attenuation in many embodiments which may result in faster noise attenuation. In many scenarios the approach may enable or allow real time noise attenuation.

A substantially smaller noise codebook (the second codebook) can be used in many embodiments compared to conventional approaches. This may reduce memory requirements.

In many embodiments the plurality of noise signal contribution candidates may not reflect any knowledge or assumption about the characteristics of the noise signal component. The noise signal contribution candidates may be generic noise signal contribution candidates and may specifically be fixed, predetermined, static, permanent and/or non-trained noise signal contribution candidates. This may allow facilitated operation and/or may facilitate generation and/or distribution of the second codebook. In particular, a training phase may be avoided in many embodiments.

Each of the desired signal candidates may have a duration corresponding to the time segment duration. Each of the noise signal contribution candidates may have a duration corresponding to the time segment duration.

Each of the desired signal candidates may be represented by a set of parameters which characterizes a signal component. For example, each desired signal candidate may comprise a set of linear prediction coefficients for a linear prediction model. Each desired signal candidate may comprise a set of parameters characterizing a spectral distribution, such as e.g. a Power Spectral Density (PSD).

Each of the noise signal contribution candidates may be represented by a set of parameters which characterizes a signal component. For example, each noise signal contribution candidate may comprise a set of parameters characterizing a spectral distribution, such as e.g. a Power Spectral Density (PSD). The number of parameters for the noise signal contribution candidates may be lower than the number of parameters for the desired signal candidates.

The noise signal component may correspond to any signal component not being part of the desired signal component. For example, the noise signal component may include white noise, colored noise, deterministic noise from unwanted noise sources, implementation noise etc. The noise signal component may be non-stationary noise which may change for different time segments. The processing of each time segment by the noise attenuator may be independent for each time segment.

The noise attenuator may specifically include a processor, circuit, functional unit or means for generating a plurality of estimated signal candidates by for each of the desired signal candidates of the first codebook generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment; a processor, circuit, functional unit or means for generating a signal candidate for the audio signal in the time segment from the estimated signal candidates; and a processor, circuit, functional unit or means for attenuating noise of the audio signal in the time segment in response to the signal candidate.

In accordance with an optional feature of the invention, the cost function is one of a Maximum Likelihood cost function and a Minimum Mean Square Error cost function.

This may provide a particularly efficient and high performing determination of the scaling and weights.

In accordance with an optional feature of the invention, the noise attenuator is arranged to calculate the scaling and weights from equations reflecting a derivative of the cost function with respect to the scaling and weights being zero.

This may provide a particularly efficient and high performing determination of the scaling and weights. In many embodiments, it may allow operation wherein the scaling and weights can be directly calculated from closed form equations. In many embodiments, it may allow a straightforward calculation of the scaling and weights without necessitating any recursive iterations or search operations.

In accordance with an optional feature of the invention, the desired signal candidates have a higher frequency resolution than the weighted combination.

This may allow practical noise attenuation with high performance. In particular, it may allow the importance of the desired signal candidate to be emphasized relative to the importance of the noise signal contribution candidate when determining the estimated signal candidates.

The degrees of freedom in defining the desired signal candidates may be higher than the degrees of freedom when generating the weighted combination. The number of parameters defining the desired signal candidates may be higher than the number of parameters defining the noise signal contribution candidates.

In accordance with an optional feature of the invention, the plurality of noise signal contribution candidates cover a frequency range and with each noise signal contribution candidate of a group of noise signal contribution candidates providing contributions in only a subrange of the frequency range, the sub ranges of different noise signal contribution candidates of the group of noise signal contribution candidates being different.

This may allow reduced complexity, facilitated operation and/or improved performance in some embodiments. In particular, it may allow for a facilitated and/or improved adaptation of the estimated signal candidate to the audio signal by adjustment of the weights.

In accordance with an optional feature of the invention, the sub ranges of the group of noise signal contribution candidates are non-overlapping.

This may allow reduced complexity, facilitated operation and/or improved performance in some embodiments.

In some embodiments, the sub ranges of the group of noise signal contribution candidates may be overlapping.

In accordance with an optional feature of the invention, the sub ranges of the group of noise signal contribution candidates have unequal sizes.

This may allow reduced complexity, facilitated operation and/or improved performance in some embodiments.

In accordance with an optional feature of the invention, each of the noise signal contribution candidates of the group of noise signal contribution candidates corresponds to a substantially flat frequency distribution.

This may allow reduced complexity, facilitated operation and/or improved performance in some embodiments. In particular, it may allow a facilitated and/or improved adaptation of the estimated signal candidate to the audio signal by adjustment of the weights.

In accordance with an optional feature of the invention, the noise attenuation apparatus further comprises a noise estimator for generating a noise estimate for the audio signal in a time interval at least partially outside the time segment, and for generating at least one of the noise signal contribution candidates in response to the noise estimate.

This may allow reduced complexity, facilitated operation and/or improved performance in some embodiments. In particular, it may in many embodiments allow a more accurate estimation of the noise signal component, in particular for systems wherein the noise may have a stationary or slowly varying component. The noise estimate may for example be a noise estimate generated from the audio signal in one or more previous time segments.

In accordance with an optional feature of the invention, the weighted combination is a weighted summation.

This may provide a particularly efficient implementation and may in particular reduce complexity and e.g. allow a facilitated determination of weights for the weighted summation.

In accordance with an optional feature of the invention, at least one of the desired signal candidates of the first codebook and the noise signal contribution candidates of the second codebook are represented by a set of parameters comprising no more than 20 parameters.

This allows low complexity. The invention may in many embodiments and scenarios provide efficient noise attenuation even for relatively coarse estimations of the signal and noise signal components.

In accordance with an optional feature of the invention, at least one of the desired signal candidates of the first codebook and the noise signal contribution candidates of the second codebook are represented by a spectral distribution.

This may provide a particularly efficient implementation and may in particular reduce complexity.

In accordance with an optional feature of the invention, the desired signal component is a speech signal component.

The invention may provide an advantageous approach for speech enhancement.

The approach may be particularly suitable for speech enhancement. The desired signal candidates may represent signal components compatible with a speech model.

According to an aspect of the invention there is provided a method of noise attenuation comprising: receiving an audio signal comprising a desired signal component and a noise signal component; providing a first codebook comprising a plurality of desired signal candidates for the desired signal component, each desired signal candidate representing a possible desired signal component; providing a second codebook comprising a plurality of noise signal contribution candidates, each noise signal contribution candidate representing a possible noise contribution for the noise signal component; segmenting the audio signal into time segments; and for each time segment performing the steps of: generating a plurality of estimated signal candidates by for each of the desired signal candidates of the first codebook generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment, generating a signal candidate for the time segment from the estimated signal candidates, and attenuating noise of the audio signal in the time segment in response to the signal candidate.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to speech enhancement by attenuation of noise. However, it will be appreciated that the invention is not limited to this application but may be applied to many other signals.

Figure 1:
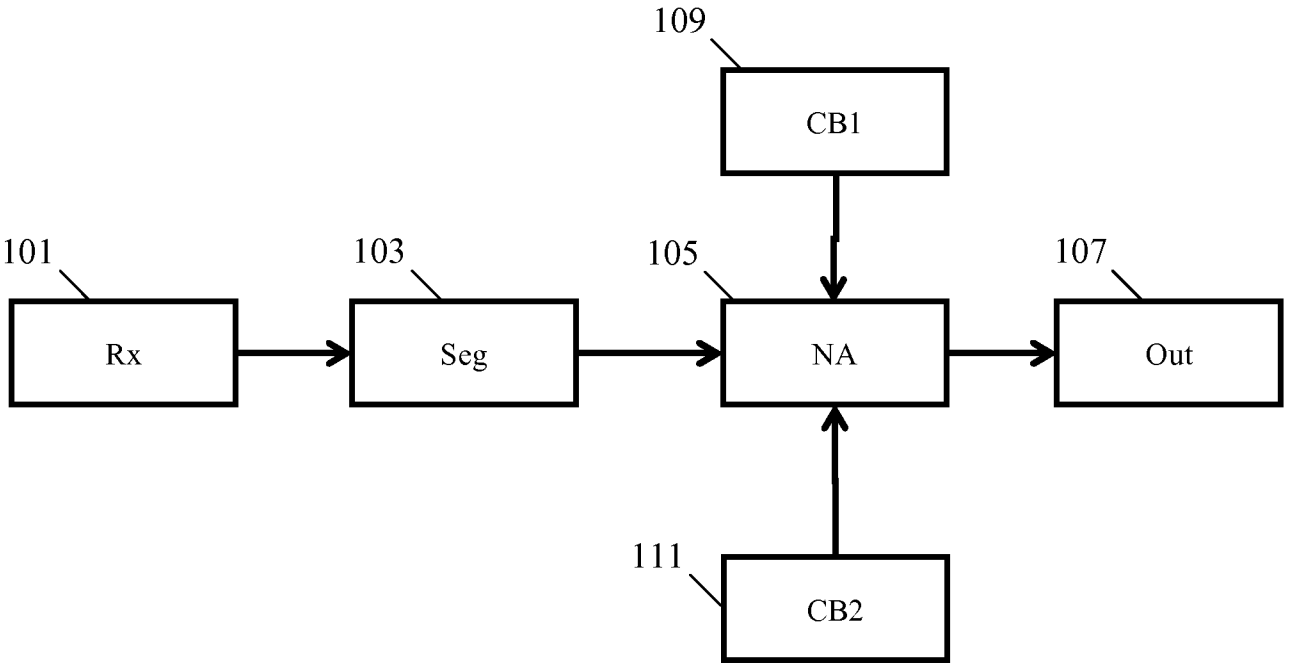
FIG. 1 is an illustration of an example of elements of a noise attenuation apparatus in accordance with some embodiments of the invention.

FIG. 1 illustrates an example of a noise attenuator in accordance with some embodiments of the invention.

The noise attenuator comprises a receiver 101 which receives a signal that comprises both a desired component and an undesired component. The undesired component is referred to as a noise signal and may include any signal component not being part of the desired signal component.

In the system of FIG. 1, the signal is an audio signal which specifically may be generated from a microphone signal capturing an audio signal in a given audio environment. The following description will focus on embodiments wherein the desired signal component is a speech signal from a desired speaker. The noise signal component may include ambient noise in the environment, audio from undesired sound sources, implementation noise etc.

The receiver 101 is coupled to a segmenter 103 which segments the audio signal into time segments. In some embodiments, the time segments may be non-overlapping but in other embodiments the time segments may be overlapping. Further, the segmentation may be performed by applying a suitably shaped window function, and specifically the noise attenuating apparatus may employ the well-known overlap and add technique of segmentation using a suitable window, such as a Hanning or Hamming window. The time segment duration will depend on the specific implementation but will in many embodiments be in the order of 10-100 msecs.

The segmenter 103 is fed to a noise attenuator 105 which performs a segment based noise attenuation to emphasize the desired signal component relative to the undesired noise signal component. The resulting noise attenuated segments are fed to an output processor 107 which provides a continuous audio signal. The output processor may specifically perform desegmentation, e.g. by performing an overlap and add function. It will be appreciated that in other embodiments the output signal may be provided as a segmented signal, e.g. in embodiments where further segment based signal processing is performed on the noise attenuated signal.

The noise attenuation is based on a codebook approach which uses separate codebooks relating to the desired signal component and to the noise signal component. Accordingly, the noise attenuator 105 is coupled to a first codebook 109 which is a desired signal codebook, and in the specific example is a speech codebook. The noise attenuator 105 is further coupled to a second codebook 111 which is a noise signal contribution codebook The noise attenuator 105 is arranged to select codebook entries of the speech codebook and the noise codebook such that the combination of the signal components corresponding to the selected entries most closely resembles the audio signal in that time segment. Once the appropriate codebook entries have been found (together with a scaling of these), they represent an estimate of the individual speech signal component and noise signal component in the captured audio signal. Specifically, the signal component corresponding to the selected speech codebook entry is an estimate of the speech signal component in the captured audio signal and the noise codebook entries provide an estimate of the noise signal component. Accordingly, the approach uses a codebook approach to estimate the speech and noise signal components of the audio signal and once these estimates have been determined they can be used to attenuate the noise signal component relative to the speech signal component in the audio signal as the estimates makes it possible to differentiate between these.

More specifically, consider an additive noise model where speech and noise are assumed to be independent:

$$y(n)=x(n)+w(n),$$

where y(n); x(n) and w(n) represent the sampled noisy speech (the input audio signal), clean speech (the desired speech signal component) and noise (the noise signal component respectively.

The prior art codebook approach searches through codebooks to find a codebook entry for the signal component and noise component such that the scaled combination most closely resembles the captured signal thereby providing an estimate of the speech and noise PSDs for each short-time segment. Let $P_y(\omega)$ denote the PSD of the observed noisy signal y(n), $P_x(\omega)$ denote the PSD of the speech signal component x(n), and $P_w(\omega)$ denote the PSD of the noise signal component, then.

$$P_y(\omega)=P_x(\omega)+P_w(\omega)$$

Letting ^ denote the estimate of the corresponding PSD, a traditional codebook based noise attenuation may reduce the noise by applying a frequency domain Wiener filter H(ω) to the captured signal, i.e.:

$$P_{na}(\omega)=P_y(\omega)H(\omega)$$

where the Wiener filter is given by:

$$H(\omega)=\frac{\hat{P}_x(\omega)}{\hat{P}_x(\omega)+\hat{P}_w(\omega)},$$

In the prior art approach, the codebooks comprise speech signal candidates and noise signal candidates respectively and the critical problem is to identify the most suitable candidate pair.

The estimation of the speech and noise PSDs, and thus the selection of the appropriate candidates, can follow either a maximum-likelihood (ML) approach or a Bayesian minimum mean-squared error (MMSE) approach.

The relation between a vector of linear prediction coefficients and the underlying PSD can be determined by $$P_x(\omega)=\frac{1}{|A_x(\omega)|^2},$$

where $\theta_x=(a_{x_0},\ldots,a_{x_p})$ are the linear prediction coefficients, $a_{x_0}=1$ and p is the linear prediction model order, and $A_x(\omega)=\Sigma_{k=0}^{p}a_{x_k}e^{-j\omega k}$.

Using this relation, the estimated PSD of the captured signal is given by $$\hat{P}_y(\omega)=\underbrace{g_xP_x(\omega)}_{\equiv\hat{P}_x(\omega)}+\underbrace{g_wP_w(\omega)}_{\equiv\hat{P}_w(\omega)},$$

where $g_x$ and $g_w$ are the frequency independent level gains associated with the speech and noise PSDs. These gains are introduced to account for the variation in the level between the PSDs stored in the codebook and that encountered in the input audio signal.

The prior art performs a search through all possible pairings of a speech codebook entry and a noise codebook entry to determine the pair that maximizes a certain similarity measure between the observed noisy PSD and the estimated PSD as described in the following.

Consider a pair of speech and noise PSDs, given by the $i^{th}$ PSD from the speech codebook and the $j^{th}$ PSD from the noise codebook. The noisy PSD corresponding to this pair can be written as $$\hat{P}_y^{ij}(\omega)=g_x^{ij}P_x^{i}(\omega)+g_w^{ij}P_w^{j}(\omega).$$

In this equation, the PSDs are known whereas the gains are unknown. Thus, for each possible pair of speech and noise PSDs, the gains must be determined. This can be done based on a maximum likelihood approach. The maximum-likelihood estimate of the desired speech and noise PSDs can be obtained in a two-step procedure. The logarithm of the likelihood that a given pair $g_x^{ij}P_x^{i}(\omega)$ and $g_w^{ij}P_w^{j}(\omega)$ have resulted in the observed noisy PSD is represented by the following equation:

$$L_{ij}(P_y(\omega),\hat{P}_y^{ij}(\omega))=\int_0^{2\pi}-\frac{P_y(\omega)}{\hat{P}_y^{ij}(\omega)}+\ln\left(\frac{1}{\hat{P}_y^{ij}(\omega)}\right)d\omega=$$
$$\int_0^{2\pi}-\frac{P_y(\omega)}{g_x^{ij}P_x^{i}(\omega)+g_w^{ij}P_w^{j}(\omega)}+\ln\left(\frac{1}{g_x^{ij}P_x^{i}(\omega)+g_w^{ij}P_w^{j}(\omega)}\right)d\omega.$$

In the first step, the unknown level terms $g_x^{ij}$ and $g_w^{ij}$ that maximize $L_{ij}(P_y(\omega),\hat{P}_y^{ij}(\omega))$ are determined. One way to do this is by differentiating with respect to $g_x^{ij}$ and $g_w^{ij}$, setting the result to zero, and solving the resulting set of simultaneous equations. However, these equations are non-linear and not amenable to a closed-form solution. An alternative approach is based on the fact that the likelihood is maximized when $P_y(\omega)=\hat{P}_y^{ij}(\omega)$, and thus the gain terms can be obtained by minimizing the spectral distance between these two entities.

Once the level terms are known, the value of $L_{ij}(P_y(\omega),\hat{P}_y^{ij}(\omega))$ can be determined as all entities are known. This procedure is repeated for all pairs of speech and noise codebook entries, and the pair that results in the largest likelihood is used to obtain the speech and noise PSDs. As this step is performed for every short-time segment, the method can accurately estimate the noise PSD even under non-stationary noise conditions.

Let {i*, j*} denote the pair resulting in the largest likelihood for a given segment, and let $g^*_x$ and $g^*_w$ denote the corresponding level terms. Then the speech and noise PSDs are given by $$\hat{P}_x(\omega)=g^*_xP_x^{i*}$$

$$\hat{P}_w(\omega)=g^*_wP_w^{j*},$$

These results thus define the Weiner filter which is applied to the input audio signal to generate the noise attenuated signal.

Thus, the prior art is based on finding a suitable desired signal codebook entry which is a good estimate for the speech signal component and a suitable noise signal codebook entry which is a good estimate for the noise signal component. Once these are found, an efficient noise attenuation can be applied.

However, the approach is very complex and resource demanding. In particular, all possible combinations of the noise and speech codebook entries must be evaluated to find the best match. Further, since the codebook entries must represent a large variety of possible signals this results in very large codebooks, and thus in many possible pairs that must be evaluated. In particular, the noise signal component may often have a large variation in possible characteristics, e.g. depending on specific environments of use etc. Therefore, a very large noise codebook is often required to ensure a sufficiently close estimate. This results in very high computational demands as well as high requirements for storage of the codebooks. In addition, the generation of particularly the noise codebook may be very cumbersome or difficult. For example, when using a training approach, the training sample set must be large enough to sufficiently represent the possible wide variety in noise scenarios. This may result in a very time consuming process.

In the system of FIG. 1, the codebook approach is not based on a dedicated noise codebook which defines possible candidates for many different possible noise components. Rather, a noise codebook is employed where the codebook entries are considered to be contributions to the noise signal component rather than necessarily being direct estimates of the noise signal component. The estimate of the noise signal component is then generated by a weighted combination, and specifically a weighted summation, of the noise contribution codebook entries. Thus, in the system of FIG. 1, the estimation of the noise signal component is generated by considering a plurality of codebook entries together, and indeed the estimated noise signal component is typically given as a weighted linear combination or specifically summation of the noise codebook entries.

In the system of FIG. 1, the noise attenuator 105 is coupled to a signal codebook 109 which comprises a number of codebook entries each of which comprises a set of parameters defining a possible desired signal component, and in the specific example a desired speech signal.

The codebook entries for the desired signal component thus correspond to potential candidates for the desired signal components. Each entry comprises a set of parameters which characterize a possible desired signal component. In the specific example, each entry comprises a set of parameters which characterize a possible speech signal component. Thus, the signal characterized by a codebook entry is one that has the characteristics of a speech signal and thus the codebook entries introduce the knowledge of speech characteristics into the estimation of the speech signal component.

The codebook entries for the desired signal component may be based on a model of the desired audio source, or may additionally or alternatively be determined by a training process. For example, the codebook entries may be parameters for a speech model developed to represent the characteristics of speech. As another example, a large number of speech samples may be recorded and statistically processed to generate a suitable number of potential speech candidates that are stored in the codebook.

Specifically, the codebook entries may be based on a linear prediction model. Indeed, in the specific example, each entry of the codebook comprises a set of linear prediction parameters. The codebook entries may specifically have been generated by a training process wherein linear prediction parameters have been generated by fitting to a large number of speech samples.

The codebook entries may in some embodiments be represented as a frequency distribution and specifically as a Power Spectral Density (PSD). The PSD may correspond directly to the linear prediction parameters.

The number of parameters for each codebook entry is typically relatively small. Indeed, typically, there are no more than 20, and often no more than 10, parameters specifying each codebook entry. Thus, a relative coarse estimation of the desired signal component is used. This allows reduced complexity and facilitated processing but has still been found to provide efficient noise attenuation in most cases.

The noise attenuator 105 is further coupled to a noise contribution codebook 111. However, in contrast to the desired signal codebook, the entries of the noise contribution codebook 109 does not generally define noise signal components as such but rather defines possible contributions to the noise signal component estimate. The noise attenuator 105 thus generates an estimate for the noise signal component by combining these possible contributions.

The number of parameters for each codebook entry of the noise contribution codebook 111 is typically also relatively small. Indeed, typically, there are no more than 20, and often no more than 10, parameters specifying each codebook entry. Thus, a relative coarse estimation of the noise signal component is used. This allows reduced complexity and facilitated processing but has still been found to provide efficient noise attenuation in most cases. Further, the number of parameters defining the noise contribution codebook entries is often smaller than the number of parameters defining the desired signal codebook entries.

Specifically, for a given speech codebook entry denoted by the letter i, the noise attenuator 105 generates an estimate of the audio signal in the time segment as:

$$\hat{P}_y^i(\omega) = g_x^i P_x^i(\omega) + \sum_{k=1}^{N_w} g_w^k P_w^k(\omega).$$

where $N_w$ is the number of entries in the noise contribution codebook 111, $P_w(\omega)$ is the PSD of the entry and $P_x(\omega)$ is the PSD of the entry in the speech codebook.

For the $i^{th}$ speech codebook entry, the noise attenuator 105 thus determines the best estimate for the audio signal by determining a combination of the noise contribution codebook entries. The process is then repeated for all entries of the speech codebook.

Figure 2:
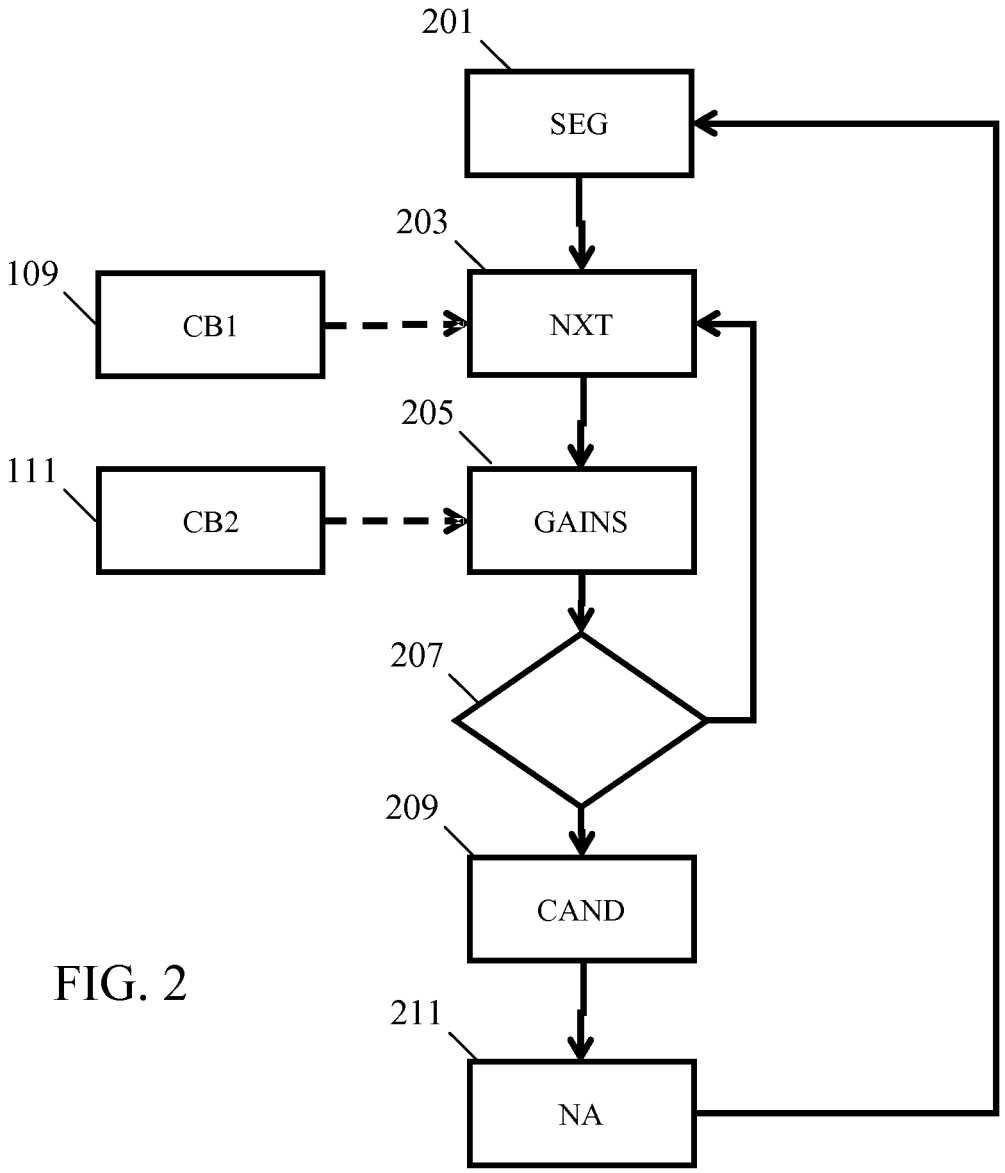
FIG. 2 is an illustration of a method of noise attenuation in accordance with some embodiments of the invention.

FIG. 2 illustrates the process in more detail. The method will be described with reference to FIG. 3 which illustrates processing elements of the noise attenuator 105. The method initiates in step 201 wherein the audio signal in the next segment is selected.

The method then continues in step 203 wherein the first (next) speech codebook entry is selected from the speech codebook 109.

Step 203 is followed by step 205 wherein the weights applied to each codebook entry of the noise contribution codebook 111 are determined as well as the scaling of the speech codebook entry. Thus, in step 205 $g_x$ and $g_w$ for each k is determined for the speech codebook entry.

The gains (scaling weights) may for example be determined using the maximum likelihood approach although it will be appreciated that in other embodiments other approaches and criteria may be used, such as for example a minimum mean square error approach.

As a specific example, the logarithm of the likelihood that a given pair $g_x^{ij}P_x^i(\omega)$ and $g_w^{ij}P_w^j(\omega)$ have resulted in the observed noisy PSD $P_y(\omega)$ is given by:

$$L_i\left(P_y(\omega), \hat{P}_y^i(\omega)\right) = \int_0^{2\pi} -\frac{P_y(\omega)}{g_x^i P_x^i(\omega) + \sum_{k=1}^{N_w} g_w^k P_w^k(\omega)} + \ln\left(\frac{1}{g_x^i P_x^i(\omega) + \sum_{k=1}^{N_w} g_w^k P_w^k(\omega)}\right) d\omega.$$

The log likelihood function may be considered as a reciprocal cost function, i.e. the larger the value the smaller the difference (in the maximum likelihood sense) between the estimated signal candidate and the input audio signal.

The unknown gain values $g_x^i$ and $g_w^k$ that maximize $L_i(P_y(\omega), \hat{P}_y^i(\omega))$ are determined. This may e.g. be done by differentiating with respect to $g_x^i$ and $g_w^k$ and setting the result to zero followed by solving the resulting equations to provide the gains (corresponding to finding the maximum of the log likelihood function and thus the minimum of the log-likelihood cost function).

Specifically, the approach can be based on the fact that the likelihood is maximized (and thus the corresponding cost function minimized) when $P_y(\omega)$ equals $\hat{P}_y^i(\omega)$. Thus the gain terms can be obtained by minimizing the spectral distance between these two entities.

First, for notational convenience, the speech and noise PSDs and the gain terms are renamed as follows:

$$P_1(\omega)=P_x^i(\omega), P_2(\omega)=P_w^1(\omega), \ldots, P_{N_w+1}(\omega)=P_w^{N_w}(\omega)$$

$$g_1=g_x^i, g_2=g_w^1, \ldots, g_{N_w+1}=g_w^{N_w},$$

so that $$\hat{P}_y^i(\omega) = \sum_{k=1}^{N_w+1} g_k P_k(\omega).$$

A cost function is minimized by maximizing the inverse-cost function of:

$$\xi = \int_0^{2\pi} \left(P_y(\omega) - \sum_{k=1}^{N_w+1} g_k P_k(\omega)\right)^2 d\omega,$$

the partial derivative of which with respect to $g_1$; $1<1\leq N_W+1$ can be set to zero to solve for the gain terms:

$$0 = \frac{d}{dg_l}\xi = \int_0^{2\pi} \left(P_y(\omega) - \sum_{k=1}^{N_w+1} g_k P_k(\omega)\right) P_l(\omega) d\omega, \; 1 \leq l \leq N_w + 1.$$

This results in the following linear system whose solution yields the desired gain terms:

$$Ag=b,$$

where $$A=[a_{kl}] \; 1\leq k,l\leq N_w+1,$$

$$a_{kl}=\int_0^{2\pi} P_k(\omega)P_l(\omega)d\omega,$$

$$g=[g_1, g_2, \ldots, g_{N_w+1}]^T,$$

$$b=[\omega_0^{2\pi} P_y(\omega)P_l(\omega)]_{1\leq l\leq N_w+1}.$$

It should be noted that the gains given by these equations may be negative. However, to ensure that only real world noise contributions are considered the gains may be required to be positive, e.g. by applying modified Karush Kuhn Tucker conditions.

Thus, step 205 proceeds to generate an estimated signal candidate for the speech codebook entry being processed. The estimated signal candidate is given as:

$$\hat{P}_y^i(\omega) = g_x^i P_x^i(\omega) + \sum_{k=1}^{N_w} g_w^k P_w^k(\omega).$$

where the gains have been calculated as described.

Following step 205, the method proceeds to step 207 where it is evaluated whether all speech entries of the speech codebook have been processed. If not, the method returns to step 203 wherein the next speech codebook entry is selected. This is repeated for all speech codebook entries.

Figure 3:
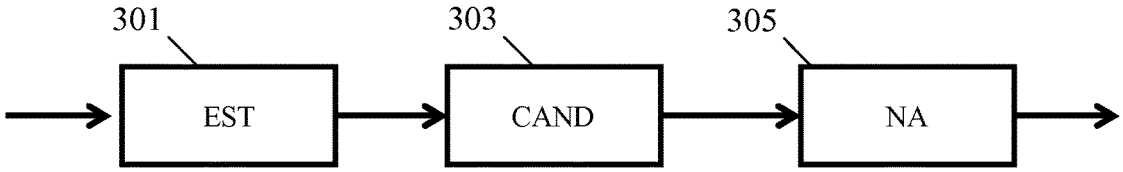
FIG. 3 is an illustration of an example of elements of a noise attenuator for the noise attenuation apparatus of FIG. 1.

Steps 201 to 207 are performed by estimator 301 of FIG. 3. Thus, the estimator 301 is a processing unit, circuit or functional element which determines an estimated signal candidate for each entry of the first codebook 109.

If all codebook entries are found to have been processed in step 207, the method proceeds to step 209 wherein a processor 303 proceeds to generate a signal candidate for the time segment based on the estimated signal candidates. The signal candidate is thus generated by considering $\hat{P}_y^i(\omega)$ for all i. Specifically, for each entry in the speech codebook 109, the best approximation to the input audio signal is generated in step 205 by determining the relative gain for the speech entry and for each noise contribution in the noise contribution codebook 111. Furthermore, the log likelihood value is calculated for each speech entry thereby providing an indication of the likelihood that the audio signal resulted from speech and noise signal components corresponding to the estimated signal candidate.

Step 209 may specifically determine the signal candidate based on the determined log likelihood values. As a low complexity example, the system may simply select the estimated signal candidate having the highest log likelihood value. In more complex embodiments, the signal candidate may be calculated by a weighted combination, and specifically summation, of all estimated signal candidates wherein the weighting of each estimated signal candidate depends on the log likelihood value.

Step 209 is followed by step 211 wherein a noise attenuation unit 303 proceeds to compensate the audio signal based on the calculated signal candidate. In particular, by filtering the audio signal with the Wiener filter:

$$H(\omega) = \frac{\hat{P}_x(\omega)}{\hat{P}_x(\omega) + \hat{P}_w(\omega)},$$

It will be appreciated that other approaches for reducing noise based on the estimated signal and noise components may be used. For example, the system may simply subtract the estimated noise candidate from the input audio signal.

Thus, step 211 generates an output signal from the input signal in the time segment in which the noise signal component is attenuated relative to the speech signal component. The method then returns to step 201 and processes the next segment.

The approach may provide very efficient noise attenuation while reducing complexity significantly. Specifically, since the noise codebook entries correspond to noise contributions rather than necessarily the entire noise signal component, a much lower number of entries are necessary. A large variation in the possible noise estimates is possible by adjusting the combination of the individual contributions. Also, the noise attenuation may be achieved with substantially reduced complexity. For example, in contrast to the conventional approach that involves a search across all combinations of speech and noise codebook entries, the approach of FIG. 1 includes only a single loop, namely over the speech codebook entries.

It will be appreciated that the noise contribution codebook 111 may contain different entries corresponding to different noise contribution candidates in different embodiments.

In particular, in some embodiments, some or all of the noise signal contribution candidates may together cover a frequency range in which the noise attenuation is performed whereas the individual candidates only cover a subset of this range. For example, a group of entries may together cover a frequency interval from, say, 200 Hz-4 kHz but each entry of the set comprises only a subrange (i.e. a part) of this frequency interval. Thus, each candidate may cover different sub ranges. Indeed, in some embodiments, each of the entries may cover a different subrange, i.e. the sub ranges of the group of noise signal contribution candidates may be substantially non-overlapping. For example, the spectral density within a frequency subrange of one candidate may be at least 6 dB higher than the spectral density of any other candidate in that subrange. It will be appreciated that in such examples the sub ranges may be separated by transition ranges. Such transition ranges may preferably be less than 10% of the bandwidth of the sub ranges.

In other embodiments, some or all noise signal contribution candidates may be overlapping such that more than one candidate provides a significant contribution to the signal strength at a given frequency.

It will also be appreciated that the spectral distribution of each candidate may be different in different embodiments. However, in many embodiments, the spectral distribution of each candidate may be substantially flat within the subrange. For example, the amplitude variation may be less than 10%. This may facilitate operation in many embodiments and may particularly allow reduced complexity processing and/or reduced storage requirements.

As a specific example, each noise signal contribution candidate may define a signal with a flat spectral density in a given frequency range. Further, the noise contribution codebook 111 may comprise a set of such candidates (possibly in addition to other candidates) that cover the entire desired frequency range in which compensation is to be performed.

Specifically, for equal width sub ranges, the entries of the noise contribution codebook 111 may be defined as $$P_w^k(\omega) = \begin{cases} 1 & \text{for } \omega \in [(k-1)\pi)\pi_w, k\pi\pi/_w], \\ 0 & \text{otherwise,} \end{cases}$$

$$\text{for } 1 \le k \le N_w \text{ and } 0 \le \omega \le \pi.$$

Thus, in some approaches the noise signal component is in this case modeled as a weighted sum of band-limited flat PSDs. It is noted that in this example, the noise contribution codebook 111 can simply be implemented by a simple equation defining all entries and there is no need for a dedicated codebook memory storing individual signal examples.

It is noted that such a weighted sum approach is able to model colored noise. The frequency resolution with which the noise estimate can be adapted to the audio signal is determined by the width of each subrange, which in turn is determined by the number of codebook entries $N_w$. However, the noise signal contribution candidates are typically arranged to have a lower resolution than the frequency resolution of the weighted summation (which results from the adjustment of the weights). Thus, the degrees of freedom available to match the noise estimate are less than the degrees of freedom available to define each desired signal candidate in the desired signal codebook 109.

This is used to ensure that the estimation of the desired signal component based on the desired signal codebook is central to the estimation of the entire signal, and specifically to reduce the risk that an erroneous or inaccurate desired signal candidate is selected due to the errors being cancelled by an adaptation of the weighted summation to the audio signal based on the wrong desired signal candidate. Indeed, if the freedom of adapting the noise component estimate is too high, the gain terms could be adjusted such that any speech codebook entry could result in an equally high likelihood. Therefore, a coarse frequency resolution (having a single gain term for a band of frequency bins of the desired signal candidates) in the noise codebook ensures that speech codebook entries that are close to the underlying clean speech result in a larger likelihood and vice-versa.

In some embodiments, the sub ranges may advantageously have unequal bandwidths. For example, the bandwidth of each candidate may be selected in accordance with psycho-acoustic principles. E.g. each subrange may be selected to correspond to and ERB or Bark band.

It will be appreciated that the approach of using a noise contribution codebook 111 comprising a number of non-overlapping band-limited PSDs of equal bandwidth is merely one example and that a number other codebooks may alternatively or additionally be used. For example, as previously mentioned, unequal width and/or overlapping bandwidths for each codebook entry may be considered. Furthermore, a combination of overlapping and non-overlapping bandwidths can be used. For instance, the noise contribution codebook 111 may contain a set of entries where the bandwidth of interest is divided into a first number of bands and another set of entries where the bandwidth of interest is divided into a different number of bands.

In some embodiments, the system may comprise a noise estimator which generates a noise estimate for the audio signal, where the noise estimate is generated considering a time interval which is at least partially outside the time segment being processed. For example, a noise estimate may be generated based on a time interval which is substantially longer than the time segment. This noise estimate may then be included as a noise signal contribution candidate in the noise contribution codebook 111 when processing the time interval.

This may provide the algorithm with a codebook entry which is likely to be close to the longer term average noise component while allowing an adaptation using the other candidates to modify this to estimate to follow the shorter term noise variations. For example, one entry of the noise codebook can be dedicated to storing the most recent estimate of the noise PSD obtained from a different noise estimate, such as for example the algorithm disclosed in R. Martin, "Noise power spectral density estimation based on optimal smoothing and minimum statistics" IEEE Trans. Speech and Audio Processing, vol. 9, no. 5, pp. 504-512, July 2001. In this manner, the algorithm may be expected to perform at least as well as the existing algorithms, and perform better under difficult conditions.

As another example, the system may average the resulting noise contribution estimates and store the longer term average as an entry in the noise contribution codebook 111.

The system can be used in many different applications including for example applications that require single microphone noise reduction, e.g., mobile telephony and DECT phones. As another example, the approach can be used in multi-microphone speech enhancement systems (e.g., hearing aids, array based hands-free systems, etc.), which usually have a single channel post-processor for further noise reduction.

It will be appreciated that the above description for clarity has described embodiments of the invention with reference to different functional circuits, units and processors. However, it will be apparent that any suitable distribution of functionality between different functional circuits, units or processors may be used without detracting from the invention. For example, functionality illustrated to be performed by separate processors or controllers may be performed by the same processor or controllers. Hence, references to specific functional units or circuits are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units, circuits and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements, circuits or method steps may be implemented by e.g. a single circuit, unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. An apparatus for attenuating noise in a received audio signal, the audio signal being a composite of a desired signal component and a noise signal component, the apparatus comprising:

a receiver for receiving the audio signal comprising the desired signal component and the noise signal component;

a memory;

a first codebook implemented in the memory and having stored therein information indicative of a plurality of desired signal candidates for the desired signal component, each desired signal candidate representing an available desired signal component;

a second codebook implemented in the memory and having stored therein information indicative of a plurality of noise signal contribution candidates, each noise signal contribution candidate representing an available noise contribution for the noise signal component;

a segmenter for segmenting the audio signal into time segments;

a noise attenuator configured to, for each time segment:

generate a plurality of estimated signal candidates by, for each of the desired signal candidates of the first codebook, generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment, wherein each of the plurality of estimated signal candidates is generated as:

$$\hat{P}_y^i(\omega) = g_x^i P_x^i(\omega) + \sum_{k=1}^{N_w} g_w^k P_w^k(\omega);$$

generate a signal candidate for the audio signal in the time segment from the estimated signal candidates; and attenuate noise of the audio signal in the time segment in response to the signal candidate, wherein the noise attenuated audio signal is fed to an output processor to perform desegmentation by performing an overlap and add function.

2. The apparatus of claim 1, wherein the cost function is one of a Maximum Likelihood cost function and a Minimum Mean Square Error cost function.

3. The apparatus of claim 1, wherein the processor is further configured to calculate the scaling and weights from equations reflecting a derivative of the cost function with respect to the scaling and weights being zero.

4. The apparatus of claim 1, wherein the desired signal candidates have a higher frequency resolution than the weighted combination.

5. The apparatus of claim 1, wherein the plurality of noise signal contribution candidates cover a frequency range and with each noise signal contribution candidate of a group of noise signal contribution candidates providing contributions in only a subrange of the frequency range, the sub ranges of different noise signal contribution candidates of the group of noise signal contribution candidates being different.

6. The apparatus of claim 5, wherein the sub ranges of the group of noise signal contribution candidates are non-overlapping.

7. The apparatus of claim 5, wherein the sub ranges of the group of noise signal contribution candidates have unequal sizes.

8. The apparatus of claim 5, wherein each of the noise signal contribution candidates of the group of noise signal contribution candidates corresponds to a substantially flat frequency distribution.

9. The apparatus of claim 1, wherein the processor is further configured as a noise estimator for generating a noise estimate for the audio signal in a time interval at least partially outside the time segment, and for generating at least one of the noise signal contribution candidates in response to the noise estimate.

10. The apparatus of claim 1, wherein the weighted combination is a weighted summation.

11. The apparatus of claim 1, wherein at least one of the desired signal candidates of the first codebook and the noise signal contribution candidates of the second codebook are represented by a set of parameters comprising no more than 20 parameters.

12. The apparatus of claim 1, wherein at least one of the desired signal candidates of the first codebook and the noise signal contribution candidates of the second codebook are represented by a spectral distribution.

13. The apparatus of claim 1, wherein the desired signal component is a speech signal component.

14. A method of attenuating noise in a received audio signal by at least a processor and a memory, the audio signal being a composite of a desired signal component and a noise signal component, the method comprising:

receiving the audio signal;

segmenting the audio signal into time segments; and for each time segment:

generating, using a first codebook having stored therein information indicative of a plurality of desired signal candidates for the desired signal component, where each desired signal candidate represents an available desired signal component, and a second codebook having stored therein information indicative of a plurality of noise signal contribution candidates, each noise signal contribution candidate representing an available noise contribution for the noise signal component, a plurality of estimated signal candidates by, for each of the desired signal candidates of the first codebook, generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment, wherein each of the plurality of estimated signal candidates is generated as:

$$\hat{P}_y^i(\omega) = g_x^i P_x^i(\omega) + \sum_{k=1}^{N_w} g_w^k P_w^k(\omega);$$

generating a signal candidate for the time segment from the estimated signal candidates, and attenuating noise of the audio signal in the time segment in response to the signal candidate, wherein the noise attenuated audio signal is fed to an output processor to perform desegmentation by performing an overlap and add function.

15. A non-transitory computer readable storage medium having stored therein a computer executable code, that when executed, causes a processor to perform a method of noise attenuation on a received audio signal that is a composite of a desired signal component and a noise signal component, the method comprising:

receiving the audio signal;

segmenting the audio signal into time segments; and for each time segment:

generating, using a first codebook having stored therein information indicative of a plurality of desired signal candidates for the desired signal component, where each desired signal candidate represents an available desired signal component, and a second codebook having stored therein information indicative of a plurality of noise signal contribution candidates, each noise signal contribution candidate representing an available noise contribution for the noise signal component, a plurality of estimated signal candidates by, for each of the desired signal candidates of the first codebook, generating an estimated signal candidate as a combination of a scaled version of the desired signal candidate and a weighted combination of the noise signal contribution candidates, the scaling of the desired signal candidate and weights of the weighted combination being determined to minimize a cost function indicative of a difference between the estimated signal candidate and the audio signal in the time segment, wherein each of the plurality of estimated signal candidates is generated as:

$$\hat{P}_y^i(\omega) = g_x^i P_x^i(\omega) + \sum_{k=1}^{N_w} g_w^k P_w^k(\omega);$$

generating a signal candidate for the time segment from the estimated signal candidates, and attenuating noise of the audio signal in the time segment in response to the signal candidate, wherein the noise attenuated audio signal is fed to an output processor to perform desegmentation by performing an overlap and add function.

* * * * *